US005887720A

United States Patent [19]

Lin

[11] Patent Number: 5,887,720

[45] Date of Patent: Mar. 30, 1999

[54] EARPHONE CASE

[76] Inventor: Teng Ko Lin, No. 423, Bao Tai Road, Chien Chen Dist., Kaohsiung, Taiwan

[21] Appl. No.: 922,592

[22] Filed: Sep. 3, 1997

[51] Int. Cl.[6] ..... B65D 85/00

[52] U.S. Cl. ..... 206/702; 206/38; 206/523

[58] Field of Search ..... 206/234, 38, 305, 206/320, 37, 521, 523, 576, 701, 702; 220/337–340; D3/218, 294

[56] References Cited

U.S. PATENT DOCUMENTS

| | | | |
|---|---|---|---|
| D. 333,560 | 3/1993 | Miyashita et al. | D3/218 |
| D. 333,917 | 3/1993 | Daido et al. | D3/218 |
| 4,106,597 | 8/1978 | Shook et al. | 206/523 |
| 4,294,349 | 10/1981 | Ibsen et al. | 206/523 |
| 5,320,219 | 6/1994 | Ward | 206/224 |

*Primary Examiner*—Paul T. Sewell
*Assistant Examiner*—Luan K. Bui
*Attorney, Agent, or Firm*—Rosenberg, Klein & Bilker

[57] ABSTRACT

An earphone case includes a base, a wind disc placed on the base for depositing an earphone and its lead wires thereon, and a cap pivotally connected with the base to close on the base. The base and the cap both have a space in an extended portion and a buffer placed in the space and having plural cavities for storing various plugs therein.

1 Claim, 4 Drawing Sheets

EARPHONE CASE

BACKGROUND OF THE INVENTION

This invention concerns an earphone case, particularly having an extended portion for providing a space for storing various plugs and thus expanding the scope of utilization of an earphone.

The purpose of an earphone is to avoid annoying other people during listening to music, and to carrying it out with oneself for convenience. And an earphone case is used to protect and store it in carrying.

A conventional earphone case shown in FIGS. 5 and 6 includes a base 10, a wind disc 20 and a cap 30.

The base 10 has a pivot portion 101 at one side to pivotally connect with a pivot portion 301 of the cap 3, a fit groove 102 at the other side, a notch 103 beside the fit groove 102, and a projection 104 on the middle of the bottom to combine with a nut 201 for securing the wind disc 20 on the base 10 after the wind disc 20 is placed in the base 10.

The wind disc 20 has a proper cavity 202 for depositing an earphone 40 therein, a mouth 203 formed at one end of the cavity 202 for a lead wire 401 of the earphone 40 to pass through, a recessed annular groove 204 for winding the lead wire 401 around it, and an annular rack 205 formed on an upper side for teeth 303 of a turn disc 302 of the cap 30 to engage and rotate along. The cap 30 has a hook 304 at one point of an annular wall to hook with the fit groove 102, a notch 305 beside the hook 304 facing the notch 103 of the base 10 to form a space for a plug 402 of the lead wire 401 to pass through out. Then in depositing the earphone 40 in the case, the turn disc 302 can be directly turned around for winding the lead wire 401 around the annular groove 204 of the wind disc 20.

However, acoustic appliances made by different makers may have different plug holes for inserting a plug, so a user of an earphone may have to prepare various plugs for corresponding to different acoustic appliances. But conventional earphone cases are not provided with a space for storing various plugs for different acoustic appliances.

SUMMARY OF THE INVENTION

The purpose of the invention is to offer an earphone case additionally having a space for storing various plugs.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
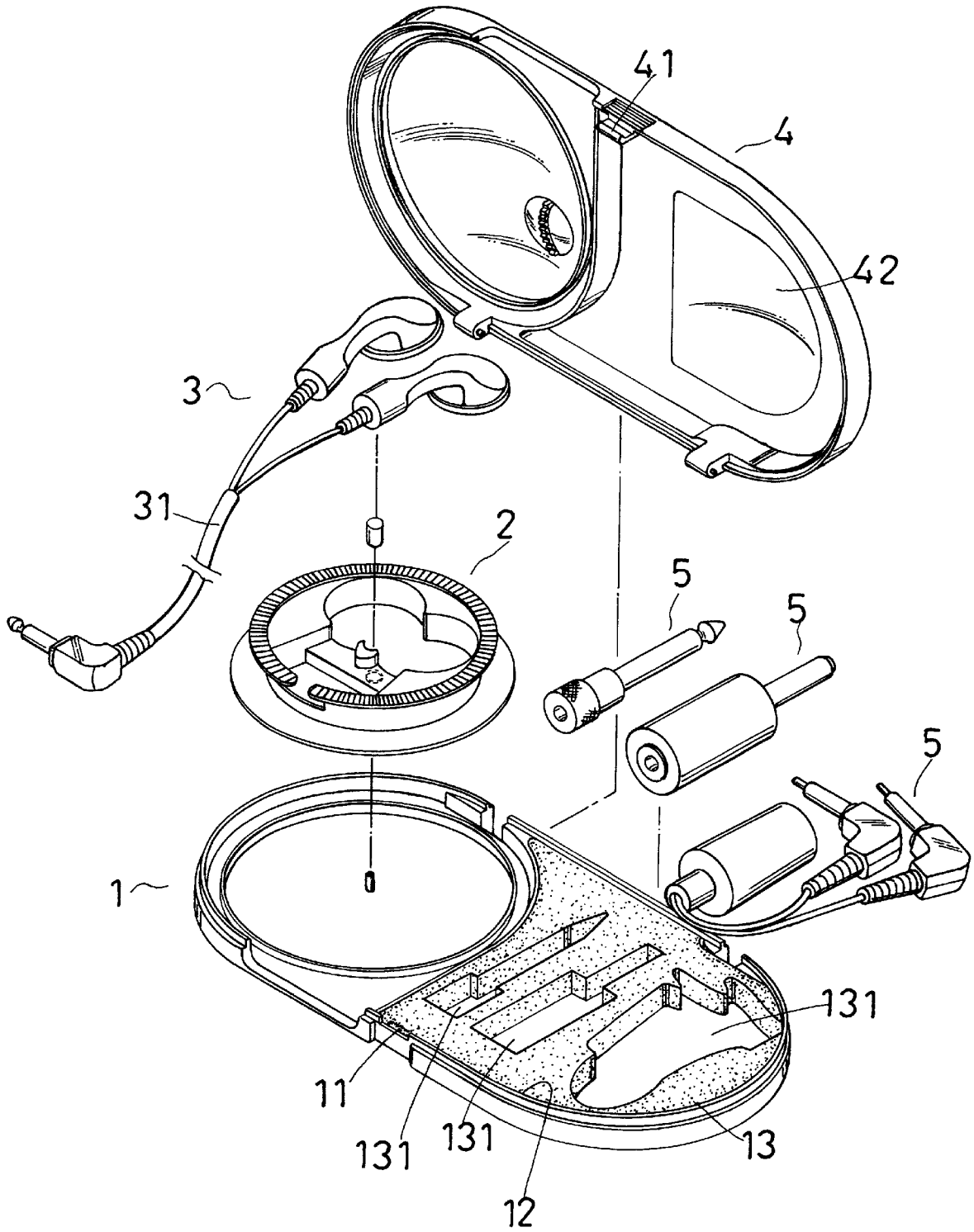
FIG. 1 is an exploded perspective view of a first preferred embodiment of an earphone case in the present invention.
Figure 6:
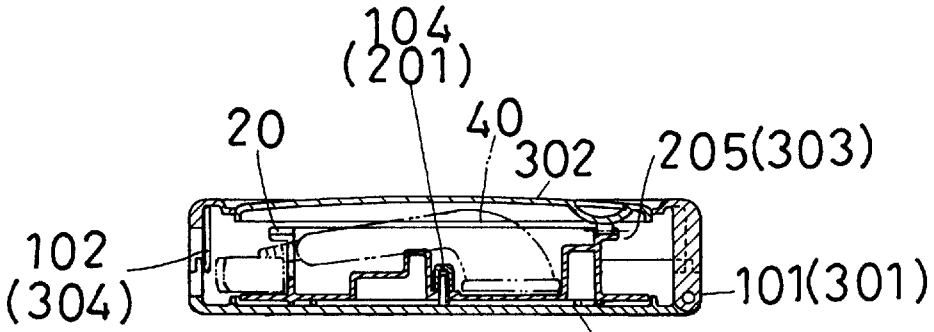
FIG. 6 (PRIOR ART)
FIG. 6 is a cross-sectional view of a conventional earphone case.
Figure 2:
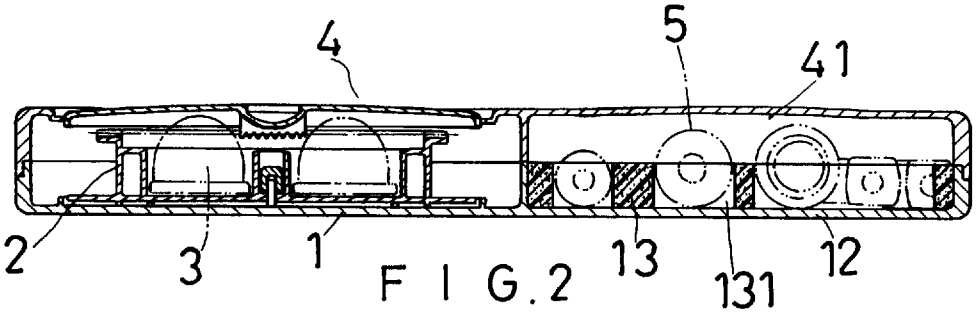
FIG. 2 is a cross-sectional view of the first preferred embodiment of an earphone case in the present invention.

A first preferred embodiment of an earphone case in the present invention, as shown in FIG. 1, has a generally same structure as the conventional one described above, having a base 1, a wind disc 2 for depositing an earphone 3 and a wound lead wire 31 therein, and a cap 4 pivotally connected with a side of the base 1. The cap 4 is further provided with a hook 41 to engage with a fit groove 11 on the other side of the base 1. The special feature of the invention different from the conventional one is a space 12 provided in an extended portion of the base 1 and a space 42 provided in an extended portion of the cap 4, and a buffer 13 with a plurality of cavities 131 deposited in the space 12 for various plugs 5 to be stored therein, as shown in FIG. 2. Then an earphone 3 and the plugs 5 are stored in the case, with the cap 4 covering on the base 1.

Figure 4:
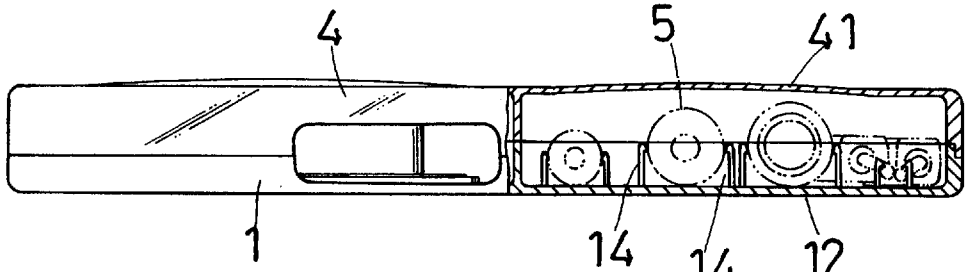
FIG. 4 is a cross-sectional view of the second preferred embodiment of an earphone case in the present invention; and, FIG. 5 is an exploded perspective view of a conventional earphone case.
Figure 3:
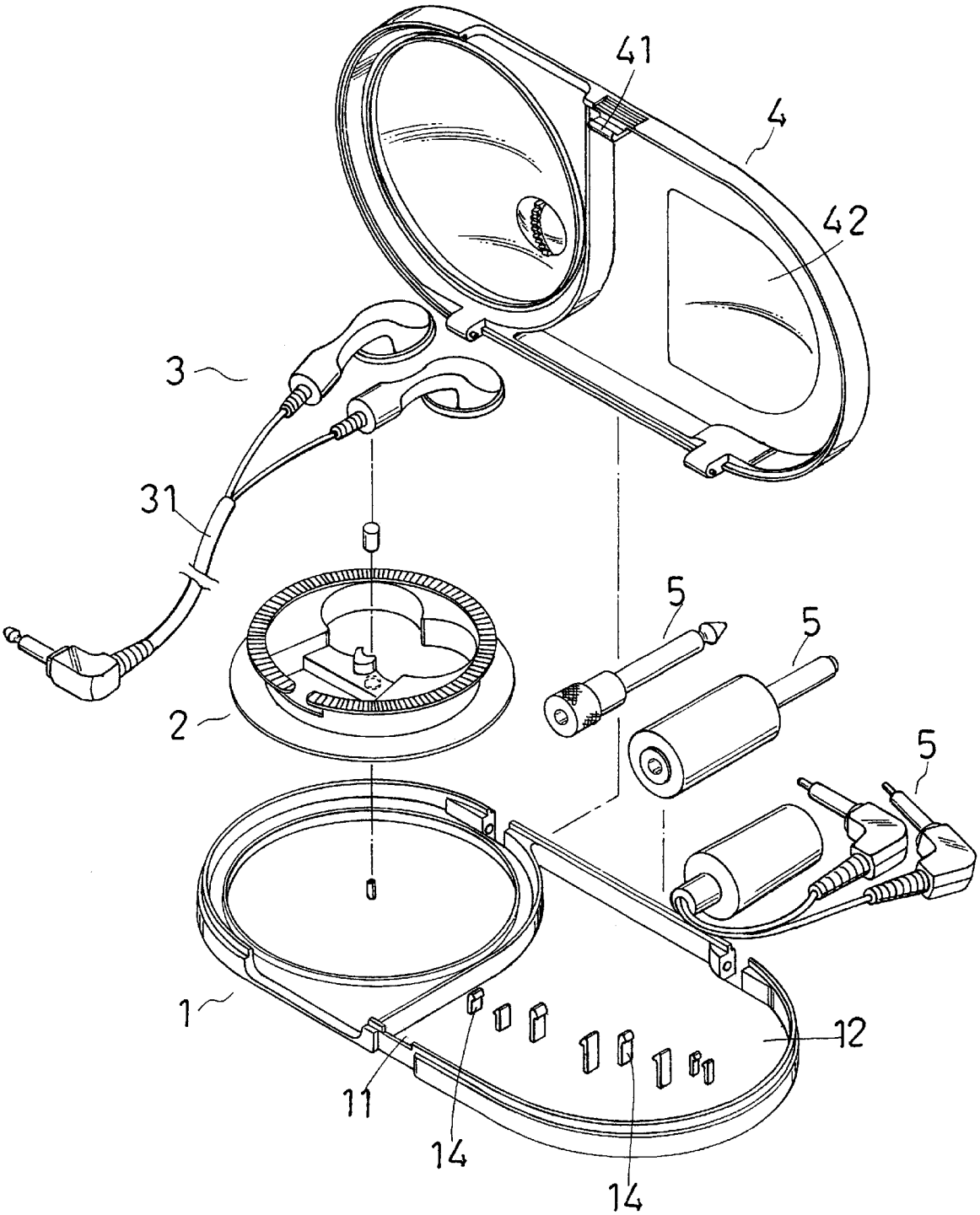
FIG. 3 is an exploded perspective view of a second preferred embodiment of an earphone case in the present invention.
Figure 5:
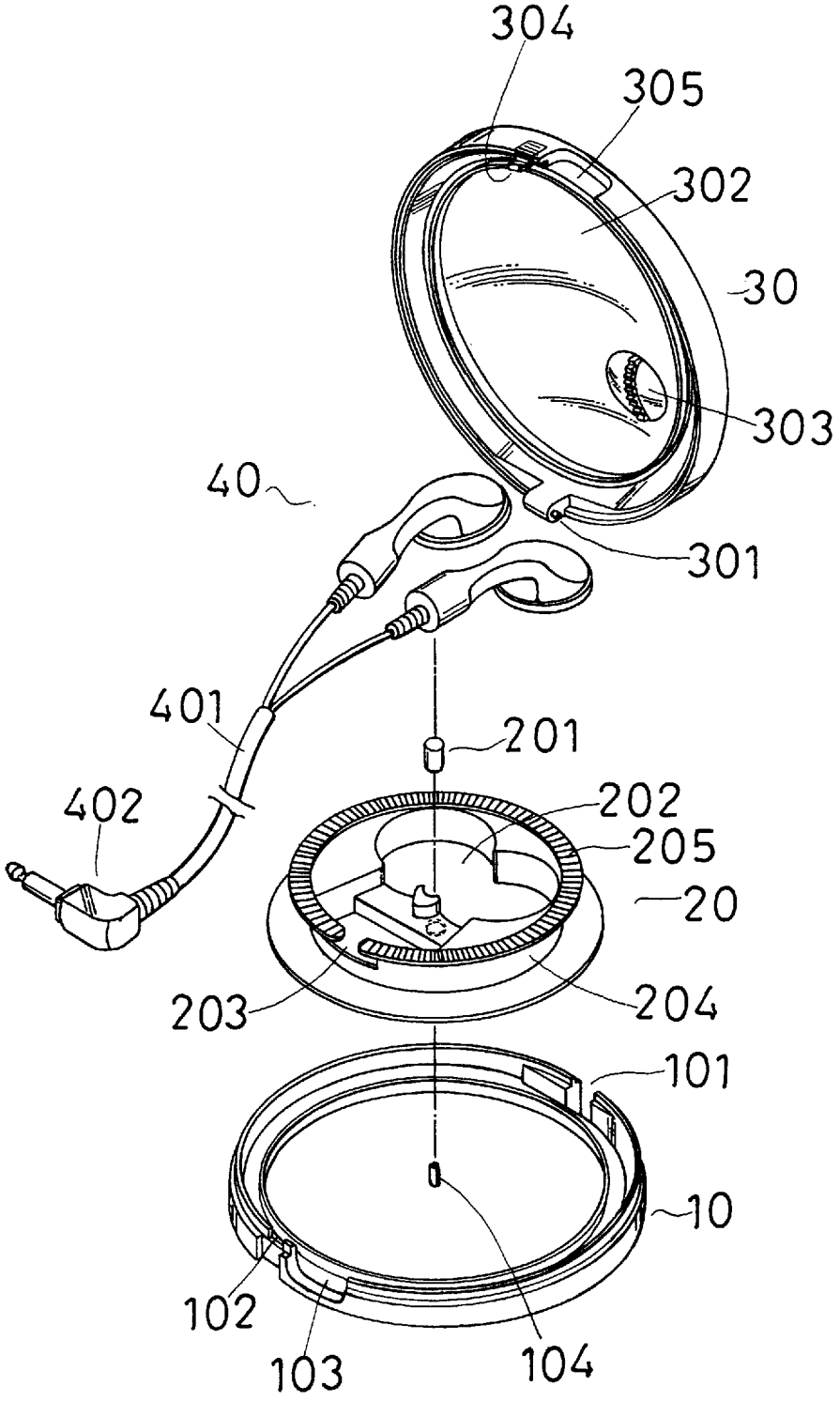
F I G.5 (PRIOR ART)

FIG. 3 shows a second preferred embodiment of an earphone case in the present invention, which includes a base 1 provided with a space 12, but the space 12 has a plurality of pairs of parallel upright hooks 14 spaced apart for respectively clamping various plugs 5 securely therein to store them in the space 12 in the base 1, as shown in FIG. 4.

While the preferred embodiments of the invention have been described above, it will be recognized and understood that various modifications may be made therein and the appended claims are intended to cover all such modifications which may fall within the spirit and scope of the invention.

What is claimed is:

1. An earphone case, comprising:

a base having a pair of opposing longitudinally extended perimeter wall portions and an intermediate wall extending between said perimeter wall portions to define a pair of longitudinally spaced base cavities;

a wind disc disposed in a first of said pair of base cavities and rotatively coupled to said base and having an annular rack formed on an upper surface of said wind disc, said wind disc having a recessed portion formed therein for receiving earphones and a recessed annular groove for winding of an earphone lead thereon;

a buffer member disposed in a second of said pair of base cavities, said buffer member having a plurality of openings formed therein for receiving earphone accessory plugs therein; and, a cap forming a closure for said base and having a pair of opposing longitudinally extended perimeter wall portions and an intermediate wall extending between said perimeter wall portions to define a pair of longitudinally spaced cap cavities disposed in correspondence with said pair of base cavities to define a pair of separate and distinct enclosures, one of said perimeter wall portions of said cap being hingedly coupled to a respective one of said perimeter wall portions of said base and the other of said perimeter wall portions of said cap having a hook for releasable coupling with a respective one of said perimeter wall portions of said base, said cap having a turn disc rotatively within a first of said pair of cap cavities, said turn disc having teeth extending therefrom for engagement with a portion of said annular rack for rotation of said wind disc within a respective one of said pair of enclosures responsive to rotation of said turn disc.

* * * * *